US005077938A

United States Patent [19]

Moreuil

[11] Patent Number: 5,077,938

[45] Date of Patent: Jan. 7, 1992

[54] REVERSIBLE SCREW-AND-NUT ACTUATING DEVICE AND SLIDING DOOR EQUIPPED WITH SUCH A DEVICE

[75] Inventor: Marc Moreuil, Tours, France

[73] Assignee: Faiveley Transport, Saint-Denis Cedex, France

[21] Appl. No.: 679,244

[22] Filed: Apr. 2, 1991

[30] Foreign Application Priority Data

Apr. 11, 1990 [FR] France ..... 90 04653

[51] Int. Cl.[5] ..... E05F 11/34

[52] U.S. Cl. ..... 49/362; 49/139; 49/141; 49/280; 49/449

[58] Field of Search ..... 49/362, 139, 141, 280, 49/449

[56] References Cited

U.S. PATENT DOCUMENTS 2,951,390 9/1960 Martens et al. ..... 49/362 X
4,198,786 4/1980 Monot ..... 49/362
4,605,108 8/1986 Monot ..... 49/362 X

FOREIGN PATENT DOCUMENTS 0248303 12/1987 European Pat. Off. .
2417620 9/1979 France .

*Primary Examiner*—Philip C. Kannan
*Attorney, Agent, or Firm*—Young & Thompson

[57] ABSTRACT

A reversible-screw- (3) and-nut (14) actuating device is connected by a coupling (12, 13) to a sliding door, the screw (3) itself being connected to a motor. A carriage (11) which can move along the screw comprises a lock (16, 22, 28, 24) for locking this carriage automatically when the nut (14) reaches one end of its travel and for unlocking it automatically when the screw is moved in the opposite direction.

The lock (16, 22, 28, 24) can move with respect to the nut and is stressed toward a locking position by a helical spring (29) working in the direction of its winding. A manual unlocking means comprises a plate (37) which can move about an axis (40) so as to align the locking finger (22) and its roller (28) with a slide channel (23) counter to the spring (29), this unlocking being possible even when the screw forces in the direction of closing for safety reasons, the unlocking then being validated only when the screw is released.

Application to a door of a public transport vehicle.

See FIG. 3.

7 Claims, 5 Drawing Sheets

REVERSIBLE SCREW-AND-NUT ACTUATING DEVICE AND SLIDING DOOR EQUIPPED WITH SUCH A DEVICE

The present invention relates to a reversible-screw-and-nut actuating device for maneuvering a movable element in translational movement, such as a leaf of a sliding door, the displacement of which can be obtained either automatically by means of a motor connected to the screw or manually, in particular in the event of an emergency, by virtue of the reversible nature of the screw/nut connection.

The invention relates more particularly to the locking of such an element which can move in translational movement, and applies in particular to the locking in the closed position of a sliding door or of a pair of such doors which have been conjugated, such as automatically opening and/or closing doors of public transport vehicles, in particular railroad vehicles.

FR-2,417,620 discloses a device for locking a sliding door, the leaf of which is connected in translational movement to a nut mounted on a reversible driving screw driven in rotation by a motor in order to ensure the opening and/or closing of the door, this nut being guided in a slide channel which prevents it from rotating. Furthermore, means are provided in order to interrupt, at the end of the travel, the guidance in translational movement of the nut and to permit it to rotate angularly with the screw so that a locking finger joined to the nut engages in a keeper formed on one side of the slide channel, after which the finger engaged in the keeper locks any translational movement of the nut and hence of the leaf. Such a locking is necessary because of the reversible nature of the screw/nut connection.

In order to open the leaf, the direction of rotation of the screw need only be reversed in order to obtain, firstly, the reverse angular rotation of the nut which ensures the unlocking and then the translational movement of the nut in the direction opening the door.

This device consequently ensures the automatic locking and unlocking functions.

Means other than the motor are also provided which make it possible, from the locked position, to cause the nut to pivot in order to unlock it, following which the leaf can be pushed manually into the open position with rotation of the screw. This permits emergency opening, for example in the event of the motor breaking down. A reversible type of screw/nut connection has been selected in order to permit the emergency opening.

However, the known device described above does not permit unlocking with a view to deferred actuation which will be termed hereinafter "anticipatory unlocking", which consists in enabling users to unlock the door whilst at the same time keeping the doors closed by supplying the motor in the closing mode. This makes it possible, in the event of a semi-emergency situation, to invite the passengers to unlock the doors before the vehicle has reached the intended disembarkation point, or when there is a fear of a breakdown but it is not known whether this breakdown will take place before reaching the platform. It is therefore a matter of allowing the passengers to get off as soon as possible, but only at the appropriate moment.

Furthermore, before releasing the doors, the engineer can attract the attention of the passengers, for example by loudspeaker, as to what precaution should be taken in order to minimize the risks of an accident.

In fact, with the known device, when the vehicle is in a situation in which the opening of the doors may prove dangerous, the engineer is obliged to place the motor permanently in the mode of closing the door and, in this case, the passenger cannot unlock the door since he would have to overcome the power of the motor transmitted in the opposite direction to the nut via the screw.

The object of the present invention is a reversible-screw-and-nut actuating device which is inexpensive to produce, does not have the abovementioned disadvantage and which, in addition to the immediate unlocking of the door, permits its anticipatory unlocking.

The subject of the present invention is a reversible-screw-and-nut actuating device for maneuvering an element such as a leaf of a sliding door, the device comprising a screw connected to a motor, a carriage which can move along the screw and is connected at least indirectly to said element, the carriage comprising a nut mounted on the screw, and a lock for locking the carriage automatically when the nut reaches one end of its travel and for unlocking the carriage automatically when the screw is moved in the direction tending to space the nut apart from said end of its travel, the device comprising means limiting the rotation of the nut about the axis of the screw, wherein the lock can move with respect to the nut and is stressed toward a locking position by a spring, and wherein the device comprises a force-transmission member connected to the nut with a clearance, and means which are sensitive to the relative position of the nut and of the force-transmission member in order to enable the spring to bring the lock into the locking position when the screw rotates in the direction stressing the nut toward said end of its travel, and in order to return the lock positively into an inactive position when the screw rotates in the opposite direction.

The subject of the present invention is also a door with a sliding leaf, in particular for a railroad vehicle, comprising a leaf associated with a device such as that described above and means for returning the lock into an inactive position counter to the action of the spring and independently of the means which can sense the relative position of the nut and of the force-transmission member.

When the carriage reaches the end of its travel, the lock passes automatically into the locking position under the action of the spring since the screw rotates in the direction stressing the nut toward said end. It is therefore the spring, and not the force of the screw, which has caused the locking and, consequently, in order to effect a "manual" unlocking, it is simply a matter of overcoming the force of the spring even if the screw is stressed in the closing direction. For automatic unlocking, it is simply a matter of rotating the screw in the reverse direction, the means which are sensitive to the relative position of the screw and of the force-transmission member then returning the lock positively into an inactive position.

By virtue of the invention, a device is thus provided in which, on the one hand, the drive screw can drive the lock automatically into the locking or unlocking position, and with which, on the other hand, whether the motor is stopped or running in the closing mode, it is possible to unlock the door manually simply by overcoming the force of the return spring of the lock, it being possible for this latter force to be predetermined in order to permit easy manual operation.

In other words, in the device of the invention, the lock is partially dissociated from the kinematic chain, and the additional function of the anticipatory unlocking can be fulfilled with simple and economical means.

Other features and advantages of the invention will emerge from the description given below by way of non-limiting example of an embodiment, reference being made to the attached drawings in which.

Figure 5:
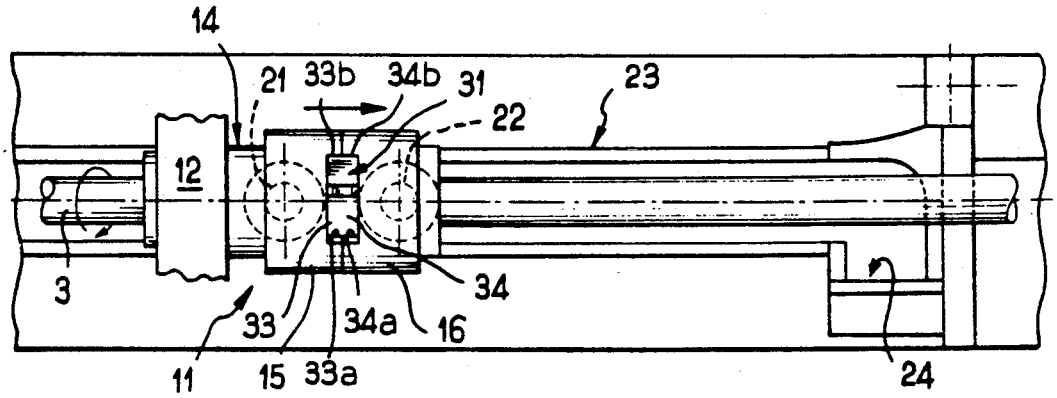
FIGS. 5 to 9 are partial diagrammatic top views of the device and of the door, corresponding to the various following configurations.
Figure 6:
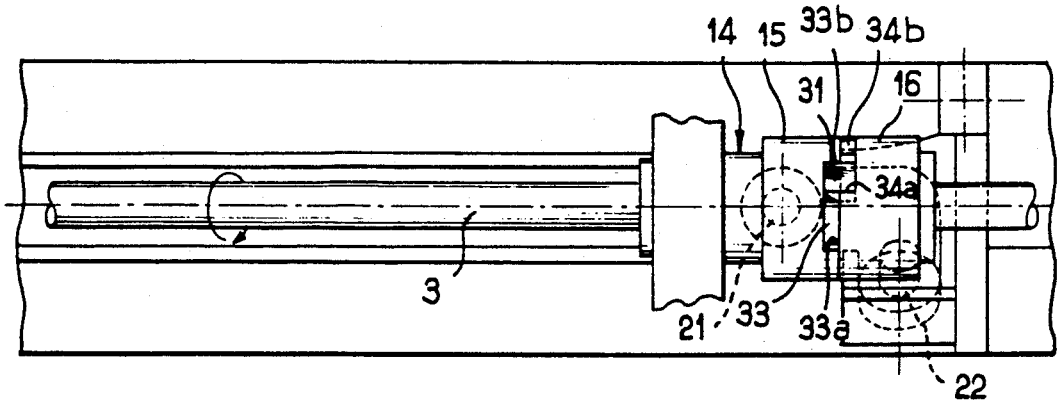
Figure 7:
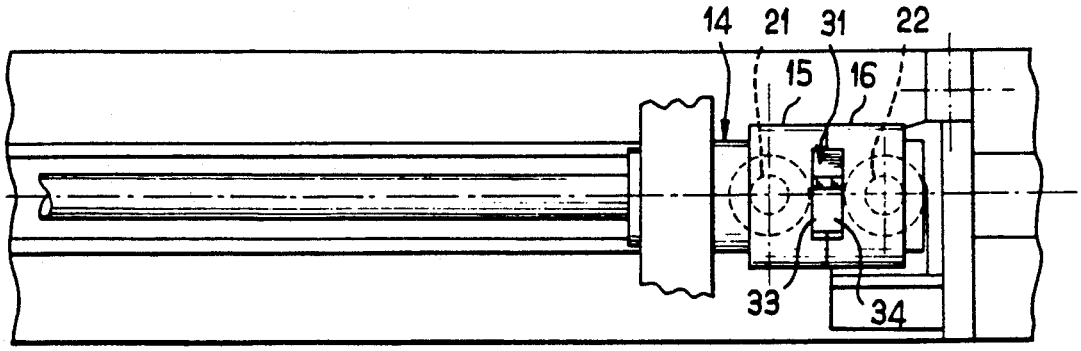
Figure 8:
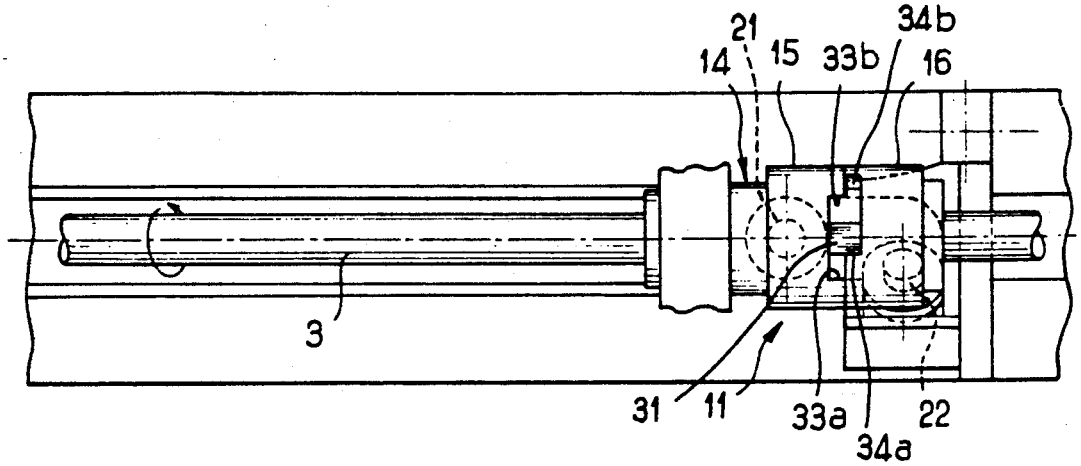
Figure 9:
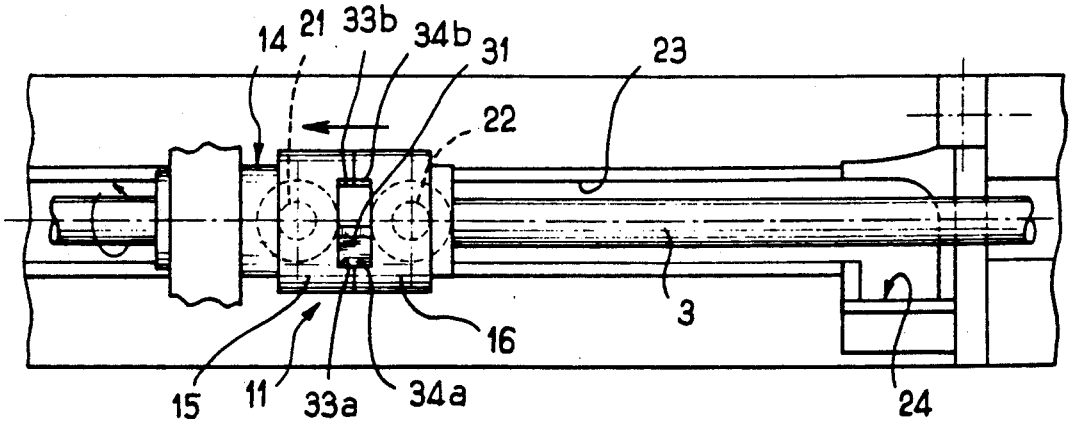

FIG. 5: door in the course of automatic closing,

FIG. 6: device after automatic locking (closed door),

FIG. 7: device after manual unlocking (closed door),

FIG. 8: device in the course of automatic unlocking (closed door),

FIG. 9: door in the course of automatic opening.

A device according to the invention has been shown in FIGS. 1, 2, 3 and 4 in the case of a door having a single leaf 1 which can be displaced between an extreme closed position indicated in solid lines, and an extreme open position shown in dot-dash lines. For its guidance during this displacement, the leaf 1 is suspended from a fixed rail 5 by two suspension plates 7 fixed on the upper edge of the leaf 1 and articulated respectively on two movable supports 8, moving along the rail 5 by means of wheels 8*a*.

The displacement of the leaf 1 is effected by an electric motor 2 driving in rotation a screw 3 of axis HH' parallel to the rail 5 and on which a carriage 11 is mounted. The latter is prevented as a whole from rotating about the axis HH' and is displaced in one or other direction along the screw 3 according to the direction of rotation of the latter.

The screw 3 is mounted so as to rotate on two fixed bearings 4 made integral with the rail 5 which is itself fixed to the frame of the door, not shown.

The carriage 11 drives the leaf 1 via a coupling 13 fixed to the leaf 1 and linked to the carriage 11 in terms of translational movement.

Figure 1:
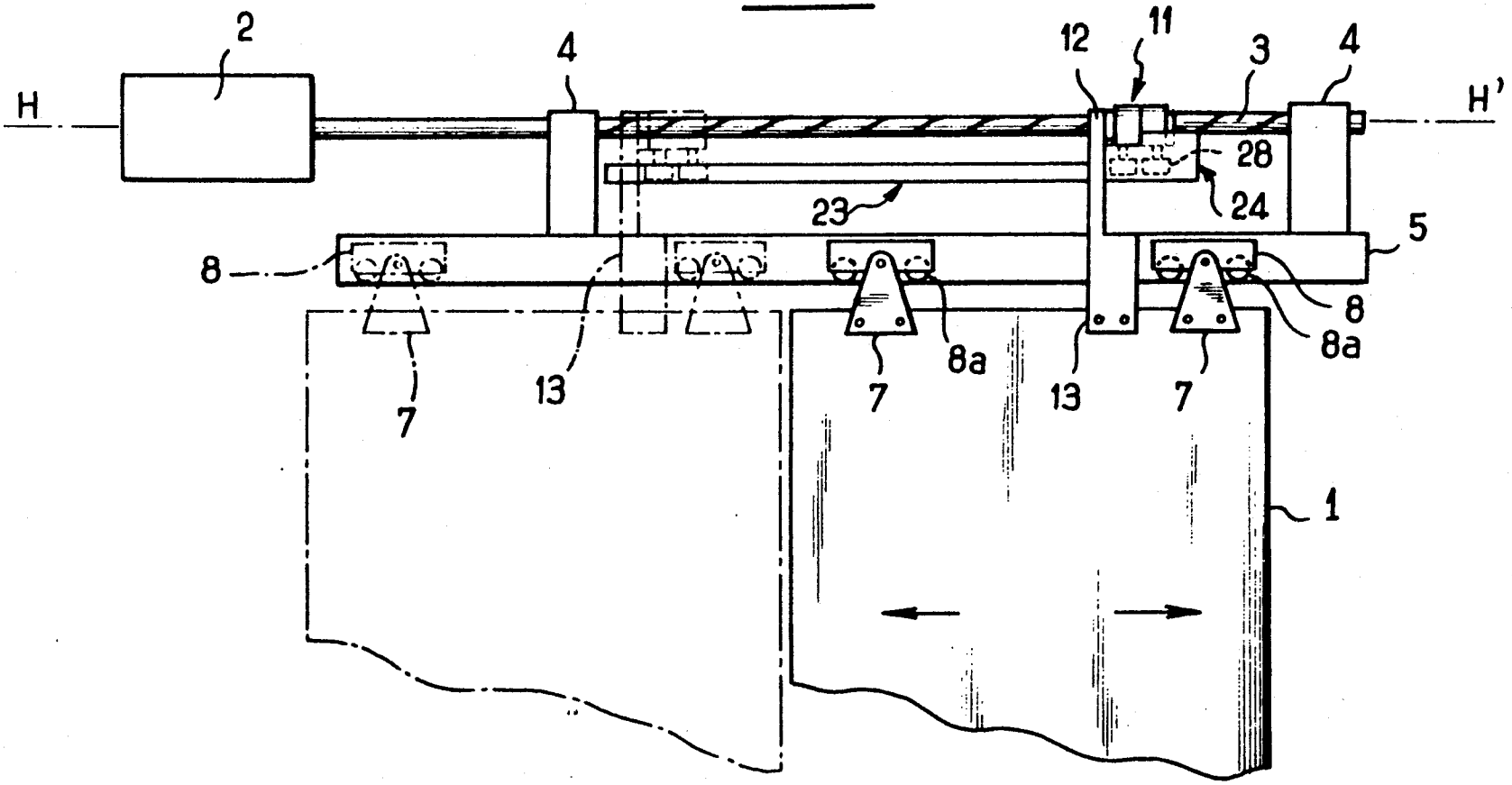
FIG. 1 is a diagrammatic representation of a door with a single leaf, equipped with a locking/unlocking device according to the invention, in two extreme positions.
Figure 2:
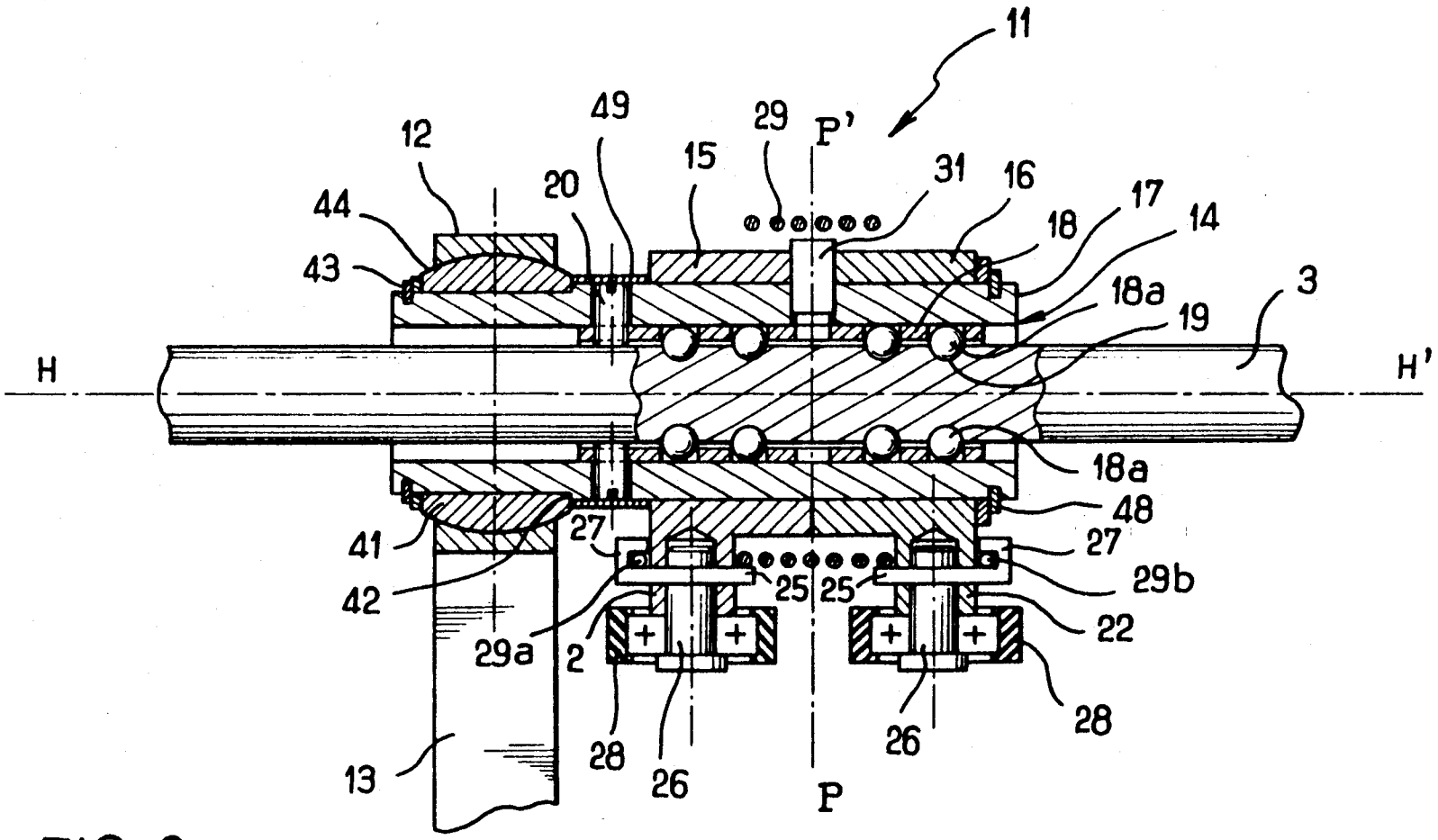
FIG. 2 is a partial longitudinal section, on an enlarged scale, of the device in FIG. 1.
Figures 3, 4:
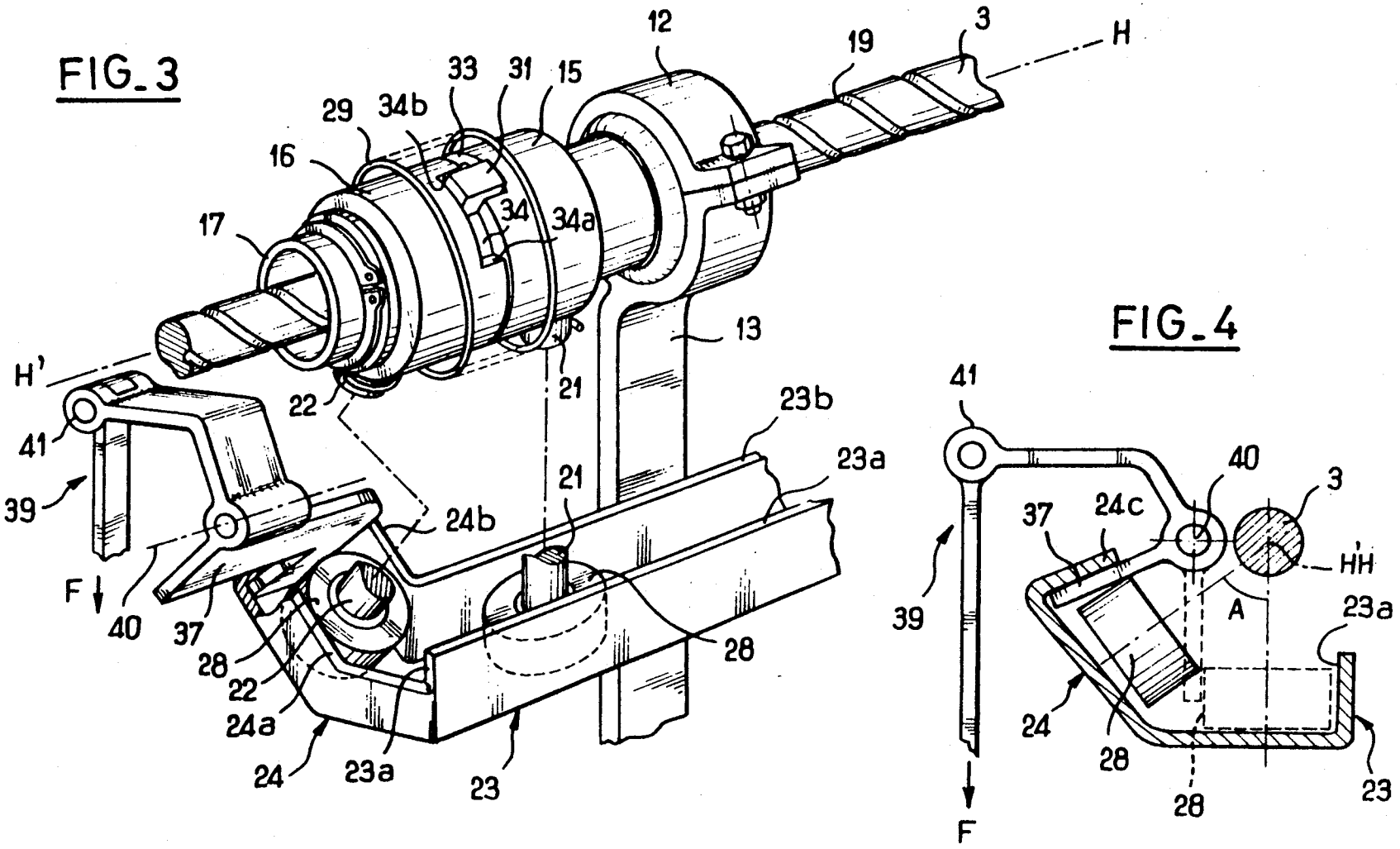
FIG. 3 is a perspective view with cutaways of the device in FIG. 1.
FIG. 4 is a partial view of the device in FIG. 3 in cross-section.

As shown in FIG. 2, the carriage 11 comprises a nut 14 which is itself composed of a tubular member 17 surrounding a ball bearing cage 18 to which it is fixed by screws 20. The ball bearings 18*a* of the cage 18 roll in the helical grooves 19 of the screw 3. At one of its axial ends, the tubular member 17 carries a collar 41 immobilized axially on the nut 14 between a shoulder 42 and an elastic ring 43. The collar 41 has a spherical outer bearing surface 44 on which swivels a complementary spherical bore of a hoop 12 constituting the upper end of the coupling 13.

Two adjacent collars are mounted on the nut 14, in a contact plane PP' transverse to the axis HH', a guide or anti-rotation collar 15 and a locking/unlocking collar 16.

The collars 15 and 16 are mounted so as to be free to pivot on the nut 14 about the axis HH' but are prevented from being displaced axially on the latter by an elastic ring 48 and a spacer 49 pressed against the collar 41. The amplitude of the pivoting of the collars 15 and 16 with respect to the tubular member 17 is limited by a projection 31 welded onto the tubular member 17. The projection 31 is traversed by the contact plane PP' of the collars 15, 16. It interacts with two respective notches 33, 34, of identical dimensions, made on the edge of each collar adjacent to the plane PP' (see FIG. 3). The extreme angular positions of the locking collar 16, with respect to the projection 31, correspond to the positions of the notch 34 in which one or other of the circumferential ends 34*a*, 34*b*, forming an abutment, is pressed circumferentially against the projection 31. The same applies for the extreme angular positions of the guide collar 15, which positions correspond to the positions of the notch 33 in which one or other of the circumferential ends 33*a*, 33*b* of this notch is pressed against the projection 31. These circumferential ends are not visible in FIG. 3 since the notch 33 is partially hidden. The angular travel of each collar 15 or 16 has a same maximum value A of approximately one eighth of a revolution with respect to the nut 14.

In their lower region, the collars 15, 16 carry respectively a guide finger 21 and a locking finger 22, each carrying a roller 28 held by a screw 26 screwed into a tapped hole made in the finger 21 or 22. Furthermore, the screws 26 are locked by pins 25 force-fitted into the fingers, each pin comprising a bent-back part 27 at its end opposite the penetrating end.

A helical spring 29, provided so as to work in the direction of its winding around the axis HH', surrounds the collars 15, 16 axially between the fingers 21 and 22. The ends 29*a* and 29*b* of the spring are fastened to the fingers 21 and 22 and retained radially by the bent-back parts 27 which thus prevent the undesired deformation of the spring.

The guide finger 21 constitutes a sliding piece engaged permanently, by way of its roller 28, in a slide channel 23 (FIGS. 1 and 3) fixed to the frame of the door and parallel to the screw 3. The guide finger 21 thus transmits, between the projection 31 joined to the nut 14 and the slide channel 23, the reaction force necessary to prevent the nut from rotating with the screw except over the angular travel A permitted by the notch 33.

The slide channel 23 comprises two opposite and parallel bearing walls 23*a* and 23*b* spaced apart from each other by a distance slightly greater than the diameter of the rollers 28. The slide channel 23 therefore permanently prevents the guide collar 15 from rotating about the axis HH'. Except when the leaf is in the closed position, the roller 28 of the locking finger 22 is also situated in the slide channel 23. The spring 29 stresses the collar 16 in rotation with respect to the collar 15 in the direction pressing the locking finger 22 against the wall 23*b*, against which the guide finger 21 presses when the screw rotates in the direction closing the leaf. The slide channel is joined, at one of its ends, and on the side of the wall 23*b*, to a keeper 24.

When the carriage 11 reaches the end of its travel closing the leaf, the locking finger 22 is opposite the keeper 24 and penetrates into the latter by rotation of the collar 16 with respect to the collar 15, and hence with respect to the slide channel 23, under the action of the spring 29. The keeper 24 comprises two parallel walls 24*a* and 24*b*, transverse to the axis HH' and the mutual distance apart of which is slightly greater than the diameter of the roller 28. The wall 24*a* is joined to the wall 23*a* and thus closes the slide channel 23. The wall 24*b* is joined to the wall 23*b*. The walls 24*a* and 24*b* are connected by a wall 24*c* which closes the keeper 24 at its circumferential end furthest from the slide channel 23. When the finger 22 is in the locking position, its roller 28 is situated axially between the walls 24*a* and 24*b* of the keeper 24, which prevents any significant axial movement of the carriage 11, and hence of the leaf 1.

Manual unlocking means are furthermore provided which comprise a plate 37 which can pivot about a fixed axis 40 oriented parallel to the axis HH' so as to be able to sweep the keeper 24. The plate 37 is controlled by a linkage 39 provided with a movable articulation 41. When the finger 22 is in the locking position under the action of the spring 29, if a manual action is exerted on the linkage 39 in the direction F (FIG. 4), the plate 37, initially placed in between the roller 28 of the finger 22 and the wall 24*c*, pivots about the axis 40 and drives, as it moves, the finger 22 until it comes into alignment with the slide channel 23, which causes the unlocking of the door.

The operation of the door provided with the device according to the invention will now be described with reference to FIGS. 5 to 9 which show diagrammatic top views of various possible configurations of the door and of its locking/unlocking device.

It is assumed, to start with, that the door is open and that the automatic closing operation has been triggered, this operation consisting in rotating the screw 3 in the direction indicated by the circular arrow (see FIG. 5). The fingers 21 and 22 are aligned with each other since they are both engaged in the slide channel 23. Their notches 33 and 34 are opposite each other and the projection 31, joined to the nut 14 stressed in rotation by the screw 3, is pressed against the ends 33*b* and 34*b* of the notches 33 and 34. It is therefore impossible for the nut to rotate, with the result that the rotation of the screw 3 causes the carriage 11 to move translationally in the direction of the arrow (from left to right in FIG. 5).

When the carriage 11 reaches the end of the closing travel (FIG. 6), the finger 22, integral with the collar 16, reaches the keeper 24 and pivots in order to be housed in the latter under the action of the spring 29. Given the initial position of the collar 16 with respect to the projection 31 (see FIG. 5), the collar 16 can pivot with respect to the projection 31 only in the same direction as the screw when the leaf closes, and this is why the keeper 24 extends in this direction from the slide channel 23.

From the above automatic locking position, it is possible to carry out either a manual unlocking of the door (see FIG. 7) or an automatic unlocking (see FIG. 8).

The manual unlocking is obtained by maneuvering the linkage 39 in the direction F (see FIGS. 3 and 4), which makes it possible to exert an action tending to cause the finger 22 to pivot counter to the action of the spring 29 in order to place the finger 22 in alignment again with the finger 21 and with the slide channel 23.

The relative position of the projection 31 and of the notch 34 permits this movement since the closing process ends with a reverse movement. The manual unlocking position of the door is thus reached, from which it is possible to push the door by hand into the open position, with the screw 3 rotating under the action of the nut 14, since the screw 3/nut 14 interengagement is of the reversible type.

For safety reasons, the possibility of opening the door manually should be controlled. This is possible by running the motor 2 in the closing mode. In this case, the passengers can unlock the leaf by hand, meeting no other resistance than that of the spring 29, since the rotation of the collar 16 between the locking and unlocking positions takes place with respect to the nut 14 and hence without requiring the rotation of the screw. However, once the user has unlocked the door manually, he cannot open the leaf as long as the motor is running in the closing mode. Thus, the desired function, namely permitting a prior manual unlocking whilst at the same time allowing the engineer to control the actual opening, is perfectly ensured.

Furthermore, even assuming that the motor is initially stopped, it is possible to effect an automatic anticipatory unlocking by a simple means such as the closing of an electric circuit caused by operating the unlocking handle of the door, the unlocking becoming effective only if the engineer interrupts this electric circuit by means of a switch.

From the automatic locking position shown in FIG. 6, it is possible to unlock the door automatically by starting up the motor 2 driving the screw 3, by rotation of the screw in the opening direction indicated by the circular arrow in FIG. 8.

In this case, the carriage 11 is initially prevented from being displaced by the finger 22 engaged in the keeper 24. This is why the nut 14 and the projection 31 begin by pivoting by ⅛th of a revolution in the same direction as the screw, which is permitted by the initial position of the projection 31 initially in contact with the end 33*b* of the notch 33 of the collar 15 immobilized in rotation by the slide channel 23. An intermediate position is shown in FIG. 8, after the beginning of the pivoting movement. This movement causes a corresponding movement of the collar 16 since the projection 31 was initially pressed against the end 34*a* of the notch 34. The finger 22 is thus returned into alignment with the slide channel 23, the situation then being that shown in FIG. 9, in which the projection 31 is pressed against the ends 33*a* and 34*a* of the notches of the collars 15 and 16 which are both prevented from rotating by the slide channel 23. The nut 14, integral with the projection 31, with the result that the rotation of the screw 3 in the opening direction causes the carriage 11 to be displaced in the opening direction of the leaf, in the direction of the arrow shown in FIG. 9.

The invention is not, of course, limited to the illustrative embodiment which has just been described and numerous modifications may be made to it without going beyond the scope of this invention.

In the example, the force-transmission means rotate with respect to the nut. It would, however, also be possible to use translational means, for example a translational play between the nut and the drive piece of the leaf.

I claim:

1. A reversible-screw-and-nut actuating device for maneuvering an element such as a leaf of a sliding door (1), the device comprising a screw (3) connected to a motor, a carriage (11) which can move along the screw and is connected at least indirectly to said element, the carriage comprising a nut (14) mounted on the screw (3) and a lock (16, 24) for locking the carriage automatically when the nut reaches one end of its travel and for unlocking the carriage (11) automatically when the screw (3) is moved in the direction tending to space the nut apart from said end of its travel, the device comprising means limiting the rotation of the nut about the axis (HH') of the screw, wherein the lock (16) can move with respect to the nut (14) and is stressed toward a locking position by a spring (29), and wherein the device comprises a force-transmission member (15) connected to the nut with a certain clearance, and means (31) which are sensitive to the relative position of the nut (14) and of the force-transmission member (15) in order to enable the spring (29) to bring the lock (16) into the locking position when the screw (3) rotates in the direction stressing the nut (14) toward said end of its travel, and in order to return the lock (16) positively into an inactive position when the screw rotates in the opposite direction.

2. The device as claimed in claim 1, wherein the clearance between the nut (14) and the force-transmission member (15) is an angular clearance, and wherein the nut carries rigidly an unlocking arrangement (31, 34) which returns the lock (16) positively into an inactive position counter to the spring (29), which spring is placed functionally in between the lock (16) and the force-transmission member (15).

3. The device as claimed in claim 1, in which the means limiting the rotation of the nut (14) comprise a sliding element (21, 28) belonging to the carriage (11) and interacting with a slide channel (23) extending along the length of the screw, wherein the force-transmission member consists of the sliding element which transmits the reaction force to the rotation of the nut, and wherein the clearance between the nut and the sliding element is an angular clearance.

4. The device as claimed in claim 3, wherein, in the inactive position, the lock (16) is aligned with the slide channel (23) and slides along the latter, this lock being situated in front of the sliding element (21, 28), relative to the movement toward said end of the travel, in order to reach a conjugated locking member (24) while the sliding element is still interengaged with the slide channel (23).

5. The device as claimed in claim 4, wherein the conjugated locking member is a keeper (24) joined to the slide channel.

6. The device as claimed in claim 1, wherein the lock (16) can move in rotation with respect to the nut about the axis of the screw (3).

7. A door with a sliding leaf, in particular for a railroad vehicle, comprising a leaf (1) associated with a device as claimed in claim 1, and means (37, 40; 39) for returning the lock (16) into the inactive position counter to the action of the spring (29) and independently of the means which are sensitive to the relative position of the nut (14) and of the force-transmission member (15,16).

* * * * *